US006645031B2

(12) United States Patent
Rothkopf et al.

(10) Patent No.: US 6,645,031 B2
(45) Date of Patent: Nov. 11, 2003

(54) PLAYBOARD WITH COLLAPSING EASEL

(75) Inventors: Richard Rothkopf, Chicago, IL (US); Donald E. Toht, Wheaton, IL (US); Gary D. Aigner, Chicago, IL (US); Mary Lenehan, Chicago, IL (US); K. Dale Weathington, Mid-Levels (HK); Lisa Gelfond, Chicago, IL (US)

(73) Assignee: Learning Curve International, Inc., Chicago, IL (US)

( * ) Notice: Subject to any disclaimer, the term of this patent is extended or adjusted under 35 U.S.C. 154(b) by 0 days.

(21) Appl. No.: 10/071,600

(22) Filed: Feb. 8, 2002

(65) Prior Publication Data

US 2003/0153235 A1 Aug. 14, 2003

(51) Int. Cl.[7] ..... A63H 3/00

(52) U.S. Cl. ..... 446/73; 248/455; 248/460; 248/464; 40/746; 40/747; 40/748; 40/754; 446/487

(58) Field of Search ..... 446/73, 487; 248/447, 248/455, 457, 460, 464; 40/748, 749, 754, 755, 756, 746, 747, 750; 403/52, 82; 16/266

(56) References Cited

U.S. PATENT DOCUMENTS

| | | | | | |
|---|---|---|---|---|---|
| 2,054,098 | A | * | 9/1936 | Rich | |
| 3,652,051 | A | * | 3/1972 | McFarlane | 248/444 |
| 3,762,675 | A | * | 10/1973 | Sankey | 248/464 |
| 3,883,108 | A | * | 5/1975 | Swartz | 248/460 |
| 4,216,936 | A | * | 8/1980 | DeSelms | 248/460 |
| 5,784,817 | A | * | 7/1998 | Behme | 40/748 |
| 6,003,831 | A | * | 12/1999 | Coleman | 248/688 |
| 6,044,758 | A | * | 4/2000 | Drake | 100/43 |
| 6,131,952 | A | | 10/2000 | Blau et al. | |
| 6,216,377 | B1 | * | 4/2001 | Painsith | 40/750 |
| 6,237,887 | B1 | * | 5/2001 | Banner | 248/459 |
| 6,282,827 | B1 | * | 9/2001 | Holmes | 40/748 |

OTHER PUBLICATIONS

1998 Wholesale Catalog by Learning Curve Toys, pp. 77–102.

1999 Wholesale Catalog by Learning Curve Toys, pp. 68–95.

(Non–Patent Documents) Internet: Toys R Us.com, Amazon.com, Imaginarium.com, yahoo.com, and google.com.

* cited by examiner

*Primary Examiner*—Derris H. Banks
*Assistant Examiner*—Ali Abdelwahed
(74) *Attorney, Agent, or Firm*—Wallenstein Wagner & Rockey, Ltd.

(57) ABSTRACT

A children's playboard of the type comprising a backing having a front surface of a cloth material for adhering figurines thereto and a back surface is disclosed. The children's playboard has a support structure. The support structure is fixedly attached to the playboard and has a pair of spaced bracing members and a pair of connection plates. Each bracing member has a first leg that is detachably joined to one of the pair of connection plates along a hinge. The bracing members are extendable at an angle from the playboard. The bracing members have a second leg and a third leg that are joined at an apex portion. The second leg having a greater length than the third leg. The apex is located between the second and third legs and provides support for the bracing members against a base surface wherein the backing member can be supported in at least two different angles to the base surface.

9 Claims, 4 Drawing Sheets

PLAYBOARD WITH COLLAPSING EASEL

TECHNICAL FIELD

The present invention relates generally to a children's laminated playboard, and more particularly, to a playboard having a collapsing easel for supporting the playboard in an upwardly angled orientation.

1. Background

Fiber covered playboards have been available for a number of years. The playboards typically consist of a cardboard backing having a layer of felt adhered to an upper surface. Felt figures are provided with the playboard and adhere to the felt layer of the playboard. The felt figures may be placed in any number of arrangements on the felt covered backing.

The playboards are generally planar. Flat laying playboards are sometimes more difficult for young children to play with, and can be less fun than playboards that are raised on an angle to the horizontal. Therefore, there is a need for an improved playboard of this type having an improved method for supporting and displaying the same.

2. Summary of the Invention

An object of the present invention is to provide a children's playboard comprising a backing having a support structure. The backing includes an outer perimeter, a front surface and a back surface. An outer layer covers at least a portion of the front surface. The outer layer is adapted for receiving and maintaining a figurine on the front surface.

The support structure is fixedly attached to the back surface of the backing. The support structure includes a bracing member spaced from the outer perimeter and extendable at an angle from the back surface. The bracing member provides support for maintaining the backing at an angle to a base surface.

Another object of the present invention is to provide the children's playboard having a connection plate. The connection plate is attached to the back surface and joined to the bracing member along a hinge about which the bracing member pivots.

Another object of the present invention is to provide the children's playboard with a bracing member having a pair of legs. The legs are joined at an apex. The apex is for supporting the backing against the base surface. One leg has a greater length than the other so that the backing can be supported on the base surface in at least two different angles.

Another object of the present invention is to provide the children's playboard with a support structure that includes a second bracing member extendable at an angle from the back surface. The second bracing member provides further support for maintaining the backing at an angle to a base surface.

Another object of the present invention is to provide the children's playboard having an anti-slip pad for engagement with the base surface.

Further objects and advantages of the present invention will become readily apparent upon reference to the drawings and following detailed description.

DETAILED DESCRIPTION

Figure 1:
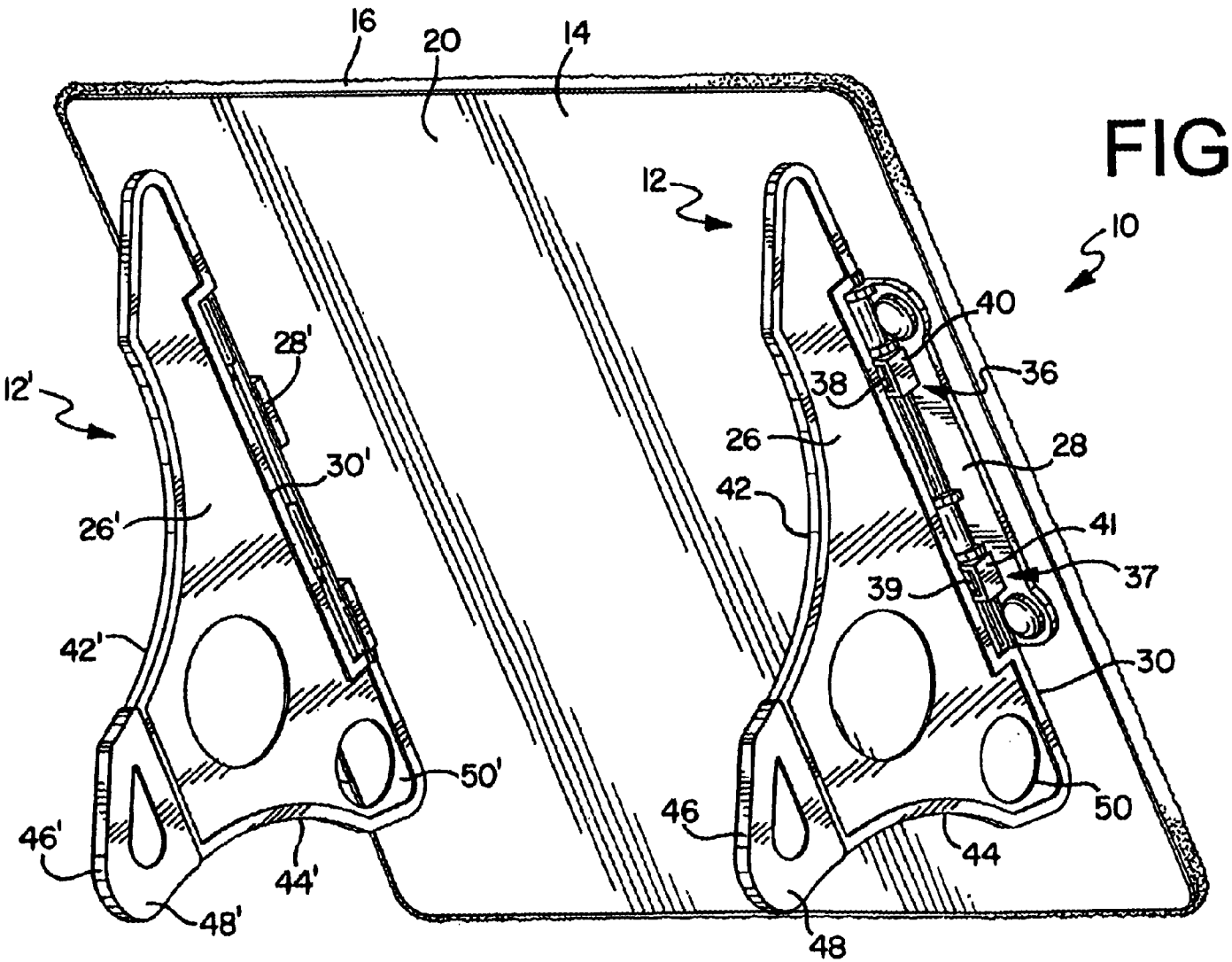
FIG. 1 is a rear perspective view of a playboard of the present invention supported at an angle on a pair of support members.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 2:
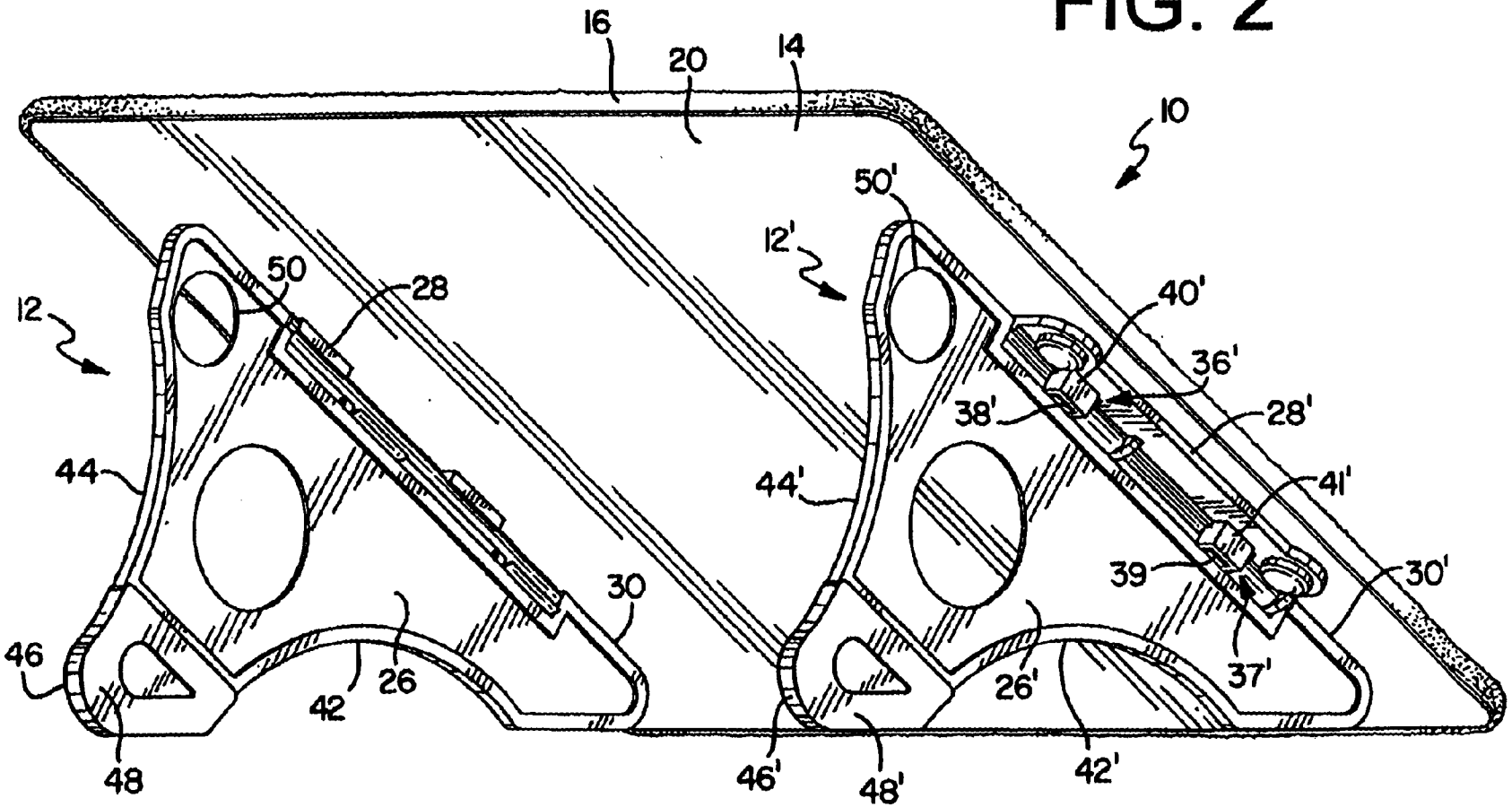
FIG. 2 is a rear perspective view of the playboard of FIG. 1 supported at a second angle on the support members.
Figure 3:
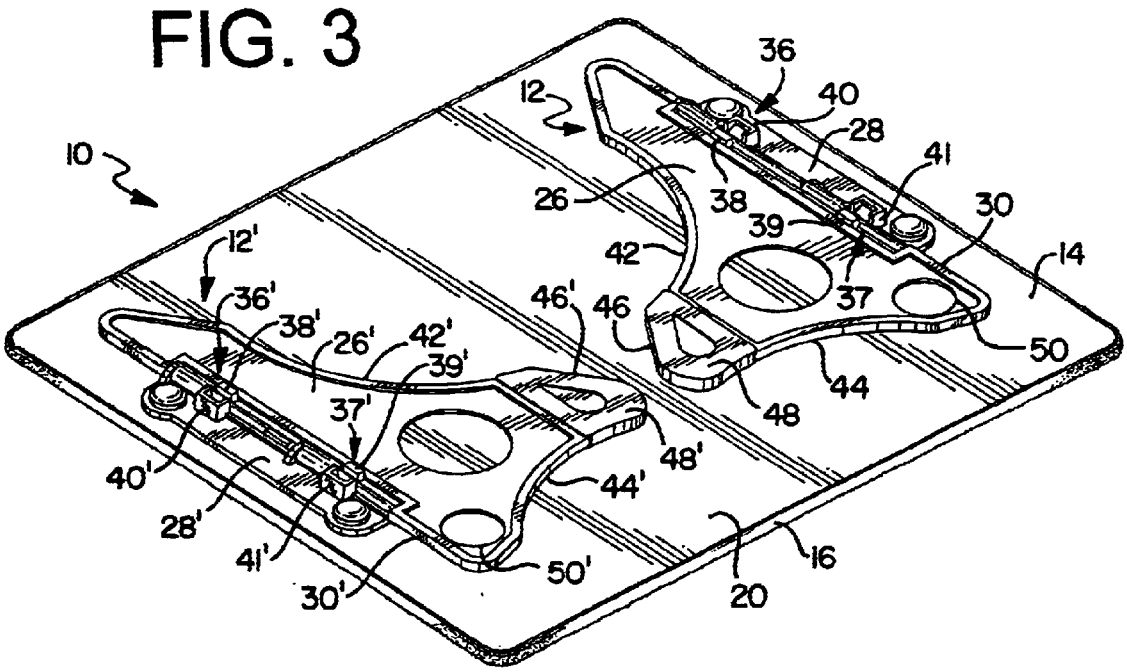
FIG. 3 is a rear view of the playboard showing the support member folded inwardly.
Figure 4:
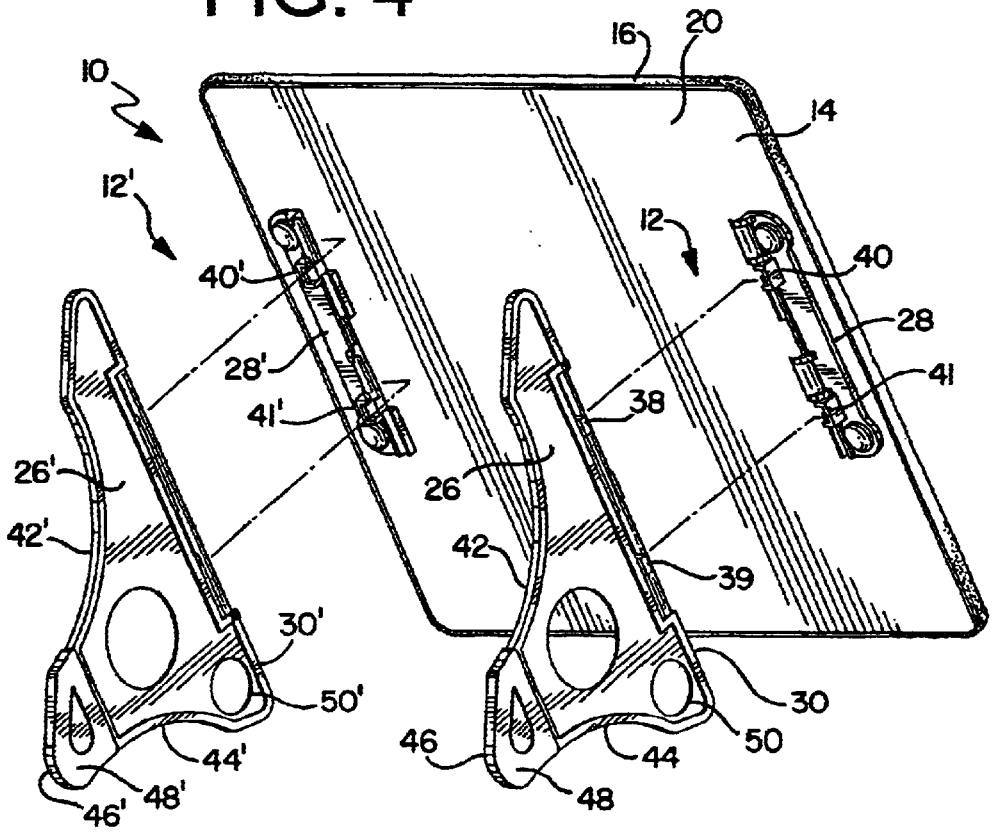
FIG. 4 is a rear view of the playboard showing the support member detached from the playboard.
Figure 5:
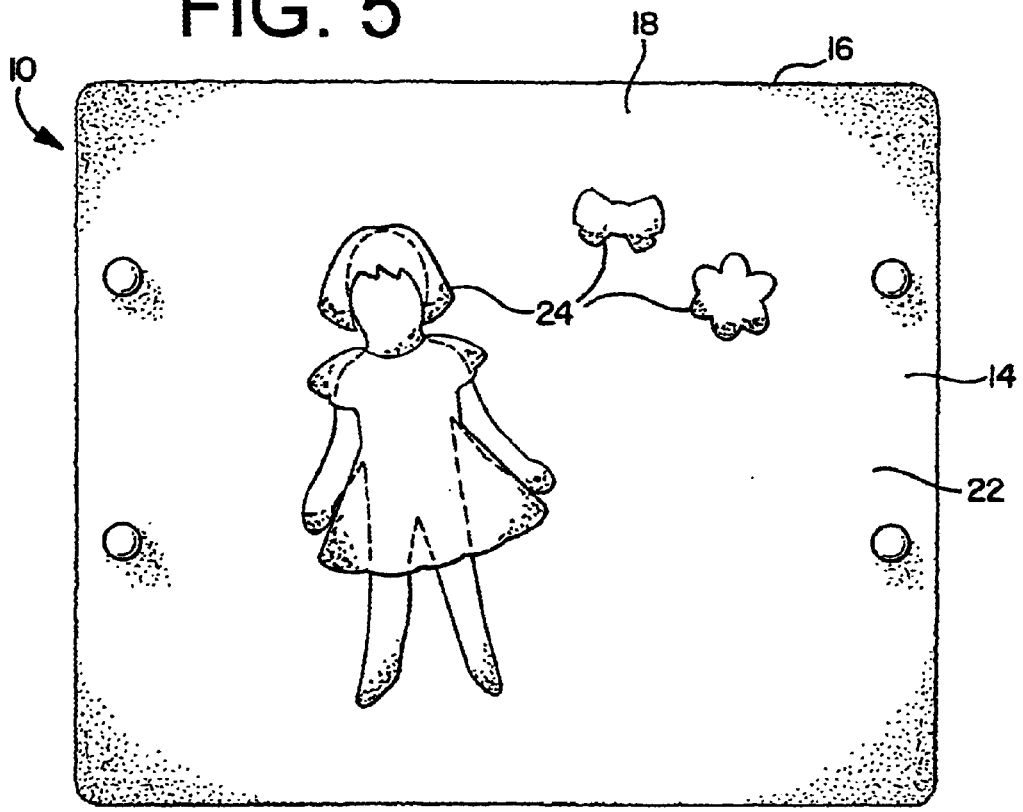
FIG. 5 is a front view of the playboard.
Figure 6:
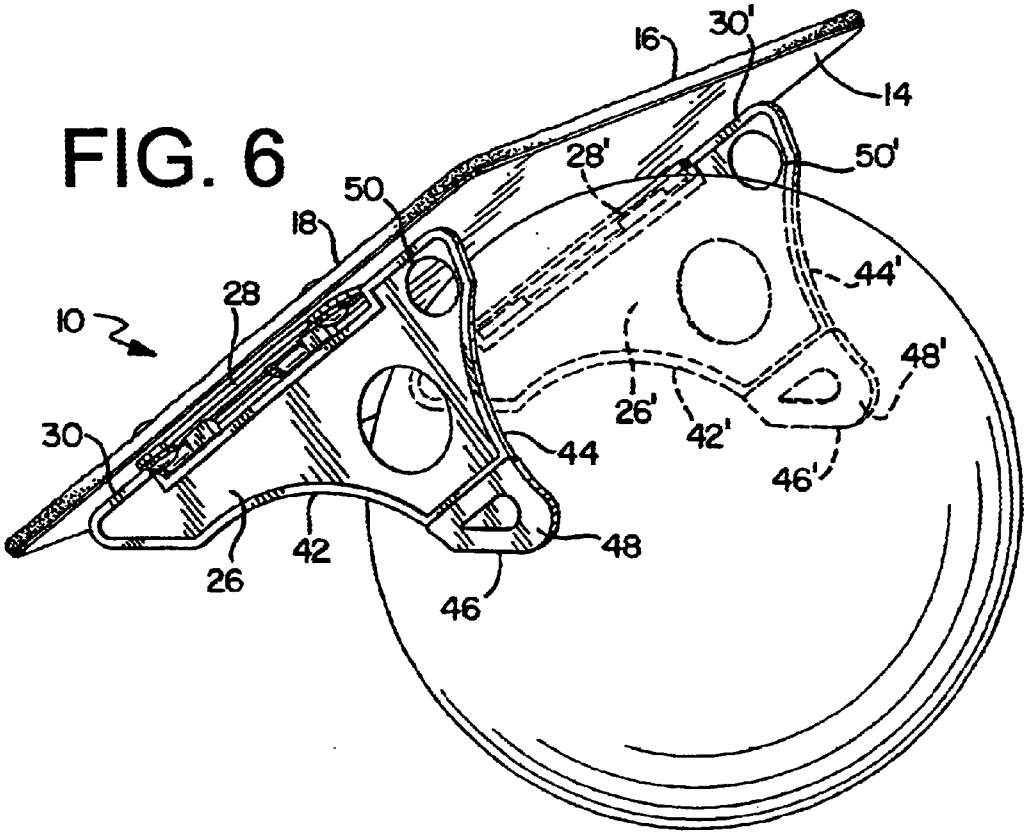
FIG. 6 is a perspective view of the playboard attached to a ball.

Referring to FIGS. 1–6. The present invention is directed to a novel children's playboard 10. The playboard 10 of the present invention includes a support structure 12, 12' for supporting the playboard at an angle to a base surface. The support structure 12, 12' allows the playboard to be supported against the base surface at different angles. The support structure 12, 12' may also be used to grip onto an external body such as a large ball. (See FIG. 6).

The playboard 10 further comprises a backing member 14 having an outer perimeter 16, a front surface 18, and a rear or back surface 20. An outer layer 22 covers the front surface 18. The outer layer 22 typically consists of a cloth laminate material, but may also be produced from any material that allows a figurine 24 to be temporarily adhered to the outer layer 22 without the use of an additional compound or substance. Typically, the cloth material is felt. Felt is chosen because figurines 24 produced from felt cloth have a tendency to adhere to an outer layer 22 produced from felt without the use of an additional adhesive or bonding agent. The figurines 24 may include animals, humans, or any object such as clothing, umbrellas, purses, etc.

The support structure 12, 12' is fixedly attached to the rear surface 20. The support structure 12, 12' comprises a pair of spaced bracing members 26, 26' and a pair of spaced connection plates 28, 28'. Each bracing member 26, 26' has a first leg 30, 30' detachably joined by a snap fit to one of the pair of connection plates 28, 28'. A hinge is formed by the first leg 30, 30' snap fit within the connection plate 28, 28'. Thus, the bracing members 26, 26' pivot about the hinges so that the bracing members 26, 26' are extendable at an angle from the rear surface 20. The snap fit allows a user to easily assemble and dissemble the support structure 12, 12' for storage, cleaning, replacement, etc.

The first legs 30, 30' and the connection plates 28, 28' cooperate to form lock members 36, 36' and 37, 37'. The first legs 30, 30' include key portions 38, 38' and 39, 39' that press fit within receivers 40, 40' and 41, 41'. The lock members 36, 36' and 37, 37' provide a means for retaining the bracing members 26, 26' in the extended position from the rear surface 20, typically a 90° angle. The locking members 36, 36' and 37, 37' further prevent the bracing members 26, 26' from pivoting beyond a predetermined angle, typically 90°.

Each bracing member 26, 26' exhibits an ornamental curvilinear shape, and further comprises a second leg 42, 42' and a third leg 44, 44' joined at an apex portion 46, 46'. The apex portion 46, 46' is provided for engagement with the base surface. The second leg 42, 42' has a greater effective length than the third leg 44, 44', and the apex 46, 46' for supporting the bracing members 26, 26' against a base surface wherein the backing member 14 can be supported at the apex 46, 46' in at least two different angles to a base surface.

Each apex portion 46, 46' includes a grip or anti-slip pad 48, 48'. The anti-slip pads 48, 48' engage the base surface to prevent the playboard 10 from skidding or sliding while in use. The anti-slip pads 48, 48' may also be used to grip an external object, such as a ball or other suitably sized object. (See FIG. 6).

Each bracing member 26, 26' further includes a hole 50, 50'. The holes 50, 50' are provided for attachment of a handle or device to hang the playboard 10. For instance, a carabiner clip can be used in conjunction with the holes to provide a means for a hanging or carrying the playboard 10. A rigid or extendable handle may also be attached to the playboard 10.

While a specific embodiment has been illustrated and described, numerous modifications are possible without departing from the spirit of the invention, and the scope of protection is only limited by the scope of the accompanying claims.

What is claimed is:

1. A children's playboard for use with a figurine of a cloth material, the playboard comprising:

a backing member having an outer perimeter, a front surface and a back surface;

an outer layer covering at least a portion of the front surface, the outer layer produced from a cloth material wherein the figurine adheres thereto;

a support structure fixedly attached to the back surface of the backing member, the support structure comprising a pair of spaced bracing members and a pair of connection plates, each bracing member comprising a first leg joined to one of the pair of connection plates along a hinge wherein each bracing member is extendable at an angle from the back surface, each bracing member further comprising a second leg and a third leg joined at an apex portion, each second leg having a greater length than each corresponding third leg, and the apex portions for supporting the bracing members against a base surface wherein the backing member can be supported at the apex portions and along opposing portions of the outer perimeter of the backing member in at least two different angles to a base surface.

2. The children's playboard of claim 1 further comprising a pair of anti-slip pads attached to each apex portion for engagement with the base surface.

3. The children's playboard of claim 1 wherein the support structure further comprises a pair of locks to prevent the bracing members from extending beyond a predetermined angle on each hinge.

4. A children's playboard comprising:

a backing member having an outer perimeter, a front surface and a back surface;

an outer layer covering at least a portion of the front surface of the backing, the outer layer for receiving and maintaining a figurine thereon;

a support structure fixedly attached to the backing, the support structure including a bracing member extendable at an angle to the back surface, the bracing member comprising a first leg interconnected to the back surface, the bracing member further comprising a second leg and a third leg joined at an apex portion, the second leg having a greater length than the third leg, and the apex portion for supporting the bracing member against a base surface wherein the backing member can be supported at the apex portion and along opposing portions of the outer perimeter of the backing member in at least two different angles to a base surface.

5. The children's playboard of claim 4 wherein the support structure further comprises a connection plate, the connection plate attached to the backing and to the bracing member along a hinge about which the bracing member pivots.

6. The child's playboard of claim 5 wherein the first leg of the bracing member is snap fit within a portion of the connection plate.

7. The children's playboard of claim 4 further comprising a second support structure fixedly attached to the backing, the second support structure including a second bracing member extendable at an angle to the back surface, the second bracing member providing further support for maintaining the backing at an angle to the base surface.

8. The children's playboard of claim 7 wherein each bracing member includes an anti-slip pad for engagement with the base surface.

9. The children's playboard of claim 4 wherein the bracing member includes an anti-slip pad for engagement with the base surface.

* * * * *